US005277089A

United States Patent [19]

McGushion

[11] Patent Number: 5,277,089

[45] Date of Patent: Jan. 11, 1994

[54] TUBING UNION AND TOOL

[76] Inventor: Kevin D. McGushion, 2450 Oak St. Suite E, Santa Moncia, Calif. 90405

[21] Appl. No.: 739,766

[22] Filed: Aug. 1, 1991

[51] Int. Cl.[5] ..... B25B 27/00

[52] U.S. Cl. ..... 81/487; 81/418; 29/268

[58] Field of Search ..... 81/487, 300, 303, 311, 81/312, 13, 55, 418, 419, 304; 29/268

[56] References Cited

U.S. PATENT DOCUMENTS

| | | | |
|---|---|---|---|
| 748,546 | 12/1903 | Vail | 285/330 |
| 1,085,461 | 1/1914 | Michaelis | 81/419 |
| 2,190,478 | 2/1940 | Kleinknecht | 81/419 |
| 2,358,555 | 9/1944 | Blanchard | 81/13 |
| 2,362,828 | 11/1944 | Kading et al. | 81/13 |
| 2,390,310 | 12/1945 | Knowles | 81/311 |
| 3,205,567 | 9/1965 | Irvine et al. | 29/268 |
| 3,521,910 | 7/1970 | Callahan et al. | 285/14 |
| 4,257,135 | 3/1981 | Moebius | 29/268 |
| 4,757,588 | 7/1988 | Churchich | 29/268 |
| 4,769,891 | 9/1988 | Corral | 81/419 |

FOREIGN PATENT DOCUMENTS

| | | | |
|---|---|---|---|
| 0551634 | 1/1923 | France | 81/13 |

*Primary Examiner*—Roscoe V. Parker
*Attorney, Agent, or Firm*—Donald D. Mon

[57] ABSTRACT

A tool for assembling a union comprising first and second nuts for joining two tubing segments is disclosed. The tool includes a first and a second leg pivotally connected for scissor-like movement, each leg having an anti-torque engagement member associated with an anti-torque formation on a respective one of the nuts and tubing segments.

9 Claims, 4 Drawing Sheets

TUBING UNION AND TOOL

FIELD OF THE INVENTION

This invention relates to unions which couple two segments of tubing together, and especially to such a union which does not exert a twisting force on the tubings, and to a tool which enables this advantage.

BACKGROUND OF THE INVENTION

Especially, but not exclusively in the field of piping of hazardous gases, it is customary to couple adjacent lengths of tubing by means of a compression-type union. Such tubing is generally made of a strong corrosion resistant metal, and each segment terminates at a hard peripheral sealing surface.

These beads are opposed to one another across a sealing washer. Compressive coupling means comprising a pair of threaded-together nuts forces the segments toward the washer so as to indent the seals into the washer to make a fluid seal. The nuts bear against respective shoulders on the segments, and the segments project through central passages in the nuts.

The objective of these unions is to compress the two beads against the washer as a stack. A union of this type has been in widespread usage for many years, exemplified by Callahan U.S. Pat. No. 3,521,910, whose status approaches that of a standard in the industry. In one of its most commonly-encountered applications, it is used to couple segments of metal tubing used in chemical process equipment—for example in chip manufacturing installations, where it is referred to as a VCR (vacuum compression rad) union. For purposes of making a highly reliable fluid tight seal between the tubing segments, it is at least potentially fully adequate and is widely used.

The VCR fitting requires that the two beads be tightened down against the washer as the consequence of a combined rotary and axial motion derived from tightening the threads which join the two nuts. If the ends of the tubing segments removed from the union are free to rotate, there is no problem. However, this is usually not the situation. Instead, these tubing segments are customarily already rigidly connected to some next element. As a consequence, rotation of the tubing segments caused by tightening of the union results in deformation of the segments as a consequence of what had also become a twisting force. What is intended to be a neat assembly turns into a group of randomly distorted tubing segments. This presents a less-than-professional appearance for what is often a high-cost piece of capital equipment.

Worse still is the fact that this deformation stores restorative energy tending to loosen the union. Considerable care must be taken to assure that the union is tight enough to prevent this. Even so, events such as earthquakes cause concern that such unions might become loose.

Attempts are made, of course, to attempt to avoid these consequences. Careful installation can at least reduce the risk, and thrust washers have been suggested as a means to reduce the rotational forces exerted on the beads. Such arrangements add complexity and expense to a unit which ought to be kept as elegantly simple as possible.

Efforts have been made to place in the union itself some means to prevent relative rotation. A very old example is shown in Vail U.S. Pat. No. 748,546, and a more recent one is exemplified by applicant's own union sold commercially as the ZTNut by Exel Company 2450 Oak Street, Suite E, Santa Monica, Calif. 90405. There are others. These provide a splined article whose intent is to prevent undesired relative rotation in the union.

The efforts to improve over Callahan have had varying success, and always cost more because of the additional machining and parts they require. Applicant's ZT Nut does closely approach the ultimately desired lack of torque and non-galling sealing surfaces, but at a price. Other known attempts to solve the problems involve both additional cost and lesser performance, such as permitting independent rotation of the tubing segment.

It is an object of this invention to provide a tool, and the combination of a conventional union and this tool, which can provide the ultimate objectives without additional cost for the union, because with this invention the simple conventional device can be installed to the ultimate specifications.

It is an object of this invention to provide a simple union in which the bead seals, while being tightened, are exposed only to axial compressive sources, and neither they nor their tubings rotate relative to the washer or to each other during assembly, nor can they be independently rotated after assembly. The objections to the conventional union are thereby entirely overcome, and this is done with a simple tool.

BRIEF DESCRIPTION OF THE INVENTION

A union according to this invention includes a pair of telescoping nuts, one internally threaded (the female nut) and the other externally threaded (the male nut), the threads joining the nuts together. Each nut has a central passage which freely passes a respective tubing segment. Each tubing segment has a compression shoulder facing a matching compression shoulder on the respective nut, and an oppositely facing peripheral sealing bead. A sealing washer is placed between the beads. This describes a conventional VCR union.

According to this invention, the male nut and the tubing segments respective to the female nut are provided with anti-torque engagement means, and a tool is provided with a scissors-like pair of arms each with a complementary anti-torque engagement means. When these means are all engaged, the tubing segment associated with the female nut cannot turn relative to the male nut. Then, holding this tool against rotation, the female nut is tightened down. There is no possible rotation between the tubing segments while the female nut is being tightened on the male nut, and galling is avoided.

According to a preferred but optional feature of the invention, both sets of anti-torque engagement means also exert an axial component of force on the union.

The above and other features of this invention will be fully understood from the following detailed description and the accompanying drawings, in which:

DETAILED DESCRIPTION OF THE DRAWINGS

Figure 1:
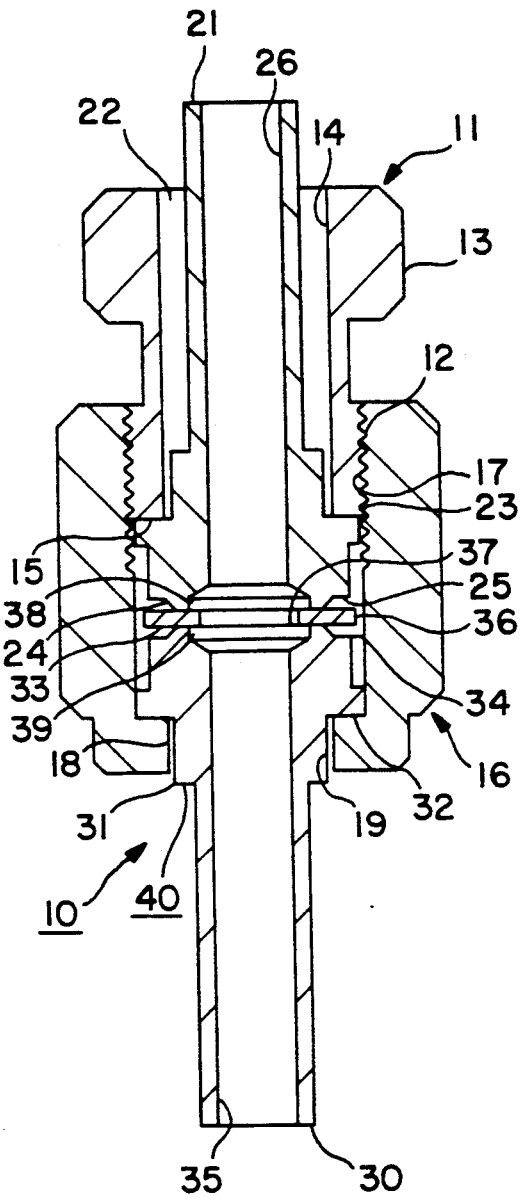
FIG. 1 is an axial cross-section of a portion of the presently-preferred embodiment of the invention, taken at line 1—1 in FIG. 2.
Figure 2:
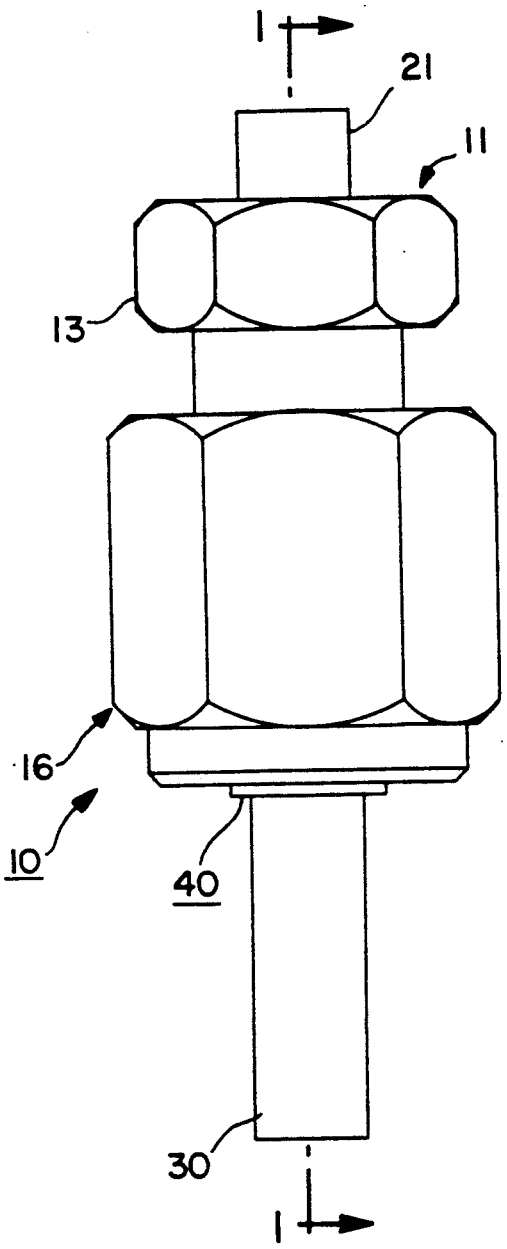
FIG. 2 is a side view of FIG. 1.

FIGS. 1 and 2 show a conventional VCR union 10 modified to include this invention. It comprises a first nut 11 with an external thread 12, a wrench engaging section 13, ("anti-torque transmission means") usually a hexagonal array, a central passage 14, and a compression shoulder 15.

A second nut 16 (the female nut) has an internal thread 17 for mating with thread 12, a compression shoulder 18, a central passage 19, and a wrench-engaging section 20 usually a hexagonal array.

A first tubing segment 21 passes through passage 14 in the male nut, with a side clearance 22. A peripheral compression shoulder 23 faces shoulder 15. A peripheral sealing bead 24 extends around face 25. A flow passage 26 extends axially from end to end of the segment, and terminates within bead 24.

A second tubing segment 30 is similar to segment 21. It passes through passage 19 in the female nut, with a side clearance 31. A peripheral compression shoulder 32 faces shoulder 18. A peripheral sealing bead 33 extends around face 34. A flow passage 35 extends axially from and to end of the segment, and terminates within bead 33.

A sealing washer 36 has a central hole 37 and two initially flat faces 38,39. It is placed between faces 25 and 34 and continues the flow passages 26 and 35.

The installed sealing washer has been indented by the beads as shown, which makes the fluid seal between the two tubing segments. The described defects of this arrangement without the invention are evident from FIGS. 1 and 2. The union is completed by tightening the nuts against one another. When the compression shoulders engage, without this invention they transmit both axial force and torque, tending to rotate the tubing segments counter-rotatively. If the segments at their ends away from the union are anchored, this represents a twist, often as much as 80 degrees at the nuts which may and often does distort the segments.

The disadvantages of the conventional VCR union are overcome even without modifying it, and even if modification are for some purposes desirable, they are only minor modification of the tubing segment respective to the female nut. This is accomplished by providing a tool which engages this tubing segment and also the the male nut to prevent their relative rotation.

The invention involves an anti-torque engagement means 40 on tubing segment 30. In the preferred embodiment this is a flat shoulder (in the conventional VCR already present). Another anti-torque engagement means 13 is a hexagonal array of flats on the male nut. This means is also already present. Thus, in the preferred embodiment, no modification of the VCR is needed.

Figure 4:
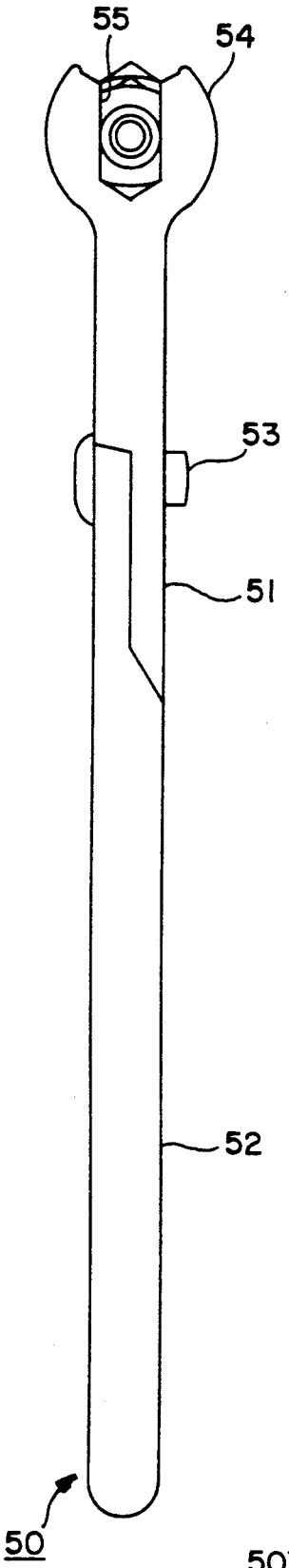
FIG. 4 is a left hand side view of FIG. 3.
Figure 3:
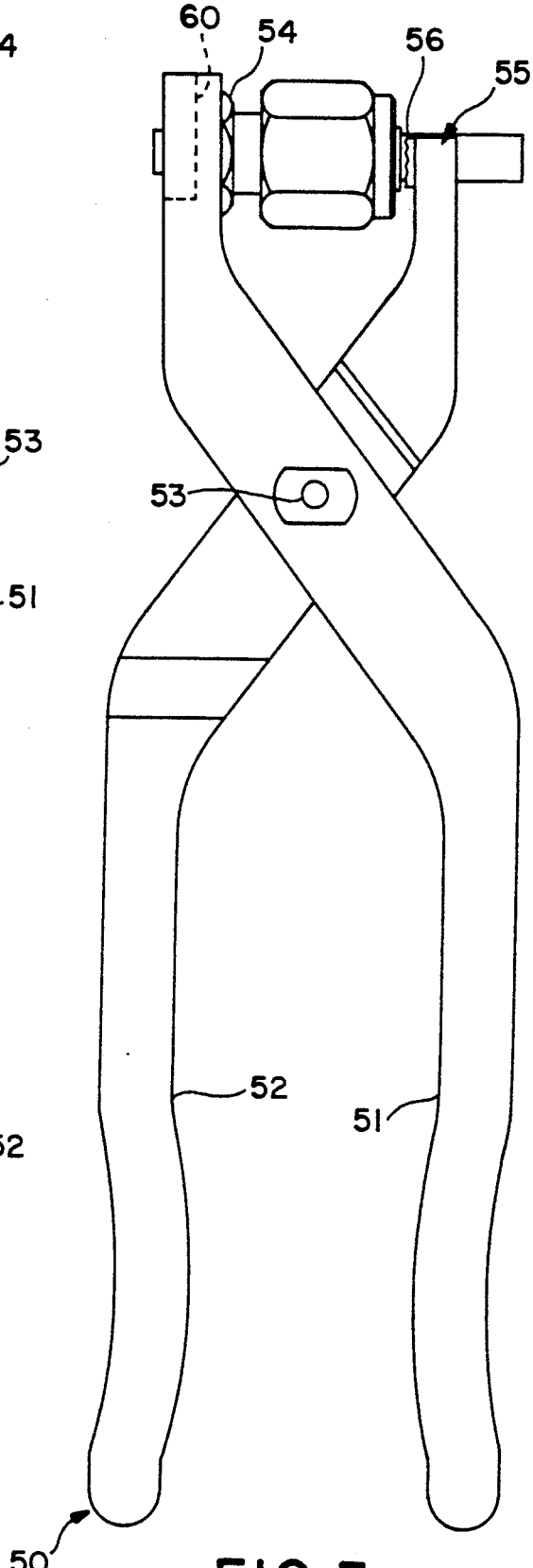
FIG. 3 is a plan view of an assembly according to the preferred embodiment.
Figure 5:
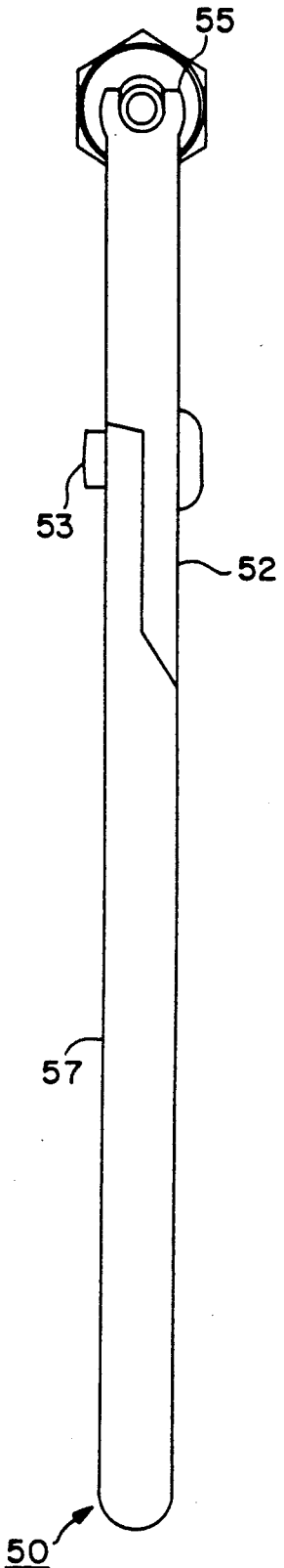
FIG. 5 is a right hand side view of FIG. 3.

In FIGS. 3-5 there is shown a tool 50 comprising a pair of scissored legs first leg 51 and second leg 52 joined at a pivot pin 53. The tool includes anti-torque engagement means 54 and 55, one on each leg.

Means 54 has flats 55 to engage at least two flats on means 41 in wrench-engaging (anti-torque) section 30.

Means 55 has an engagement surface 56 adapted to be brought against shoulder 40 on second tubing segment 30. Preferably surface 56 is serrated to give a good grip, although it can be planar, if desired. Also shoulder 40 could be serrated.

Means 54 makes a classical wrench type engagement. Means 55 generates its restraint by friction forces developed when the scissored legs are brought together. This action requires that a compressive force be exerted as well as a rotational restraint. For this reason, means 54 also has a shoulder 60 which can axially be brought to bear against the male nut.

With the tool scissored against the union, a second wrench (not shown) engages the female nut and turns it to tighten the union. The tubings cannot be counter-rotated.

It should be observed that the male nut bears against the compression shoulder on its respective tubing segment. This also generates an anti-torque relationship between them.

Other modification can be made to the second tubing segment (associated with the female nut) so there can be an anti-torque engagement between the tool and this segment. FIGS. 3-5 and 8 show the simplest, and planar abutment will usually be quite satisfactory. However, in the event that greater assurance is desired, FIGS. 6, 7, 9 and 10 show other means.

Figure 6:
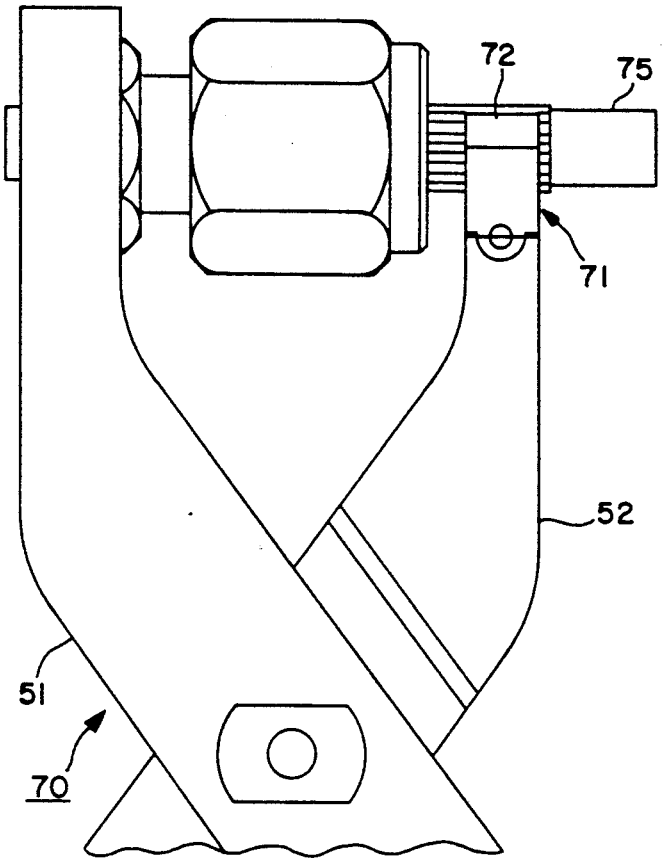
FIG. 6 is a fragmentary plan view of another embodiment of the invention.
Figure 7:
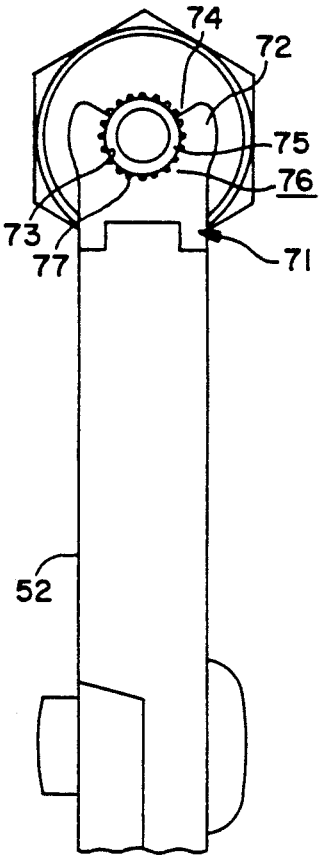
FIG. 7 is a right hand side view of FIG. 6.

FIG. 6 shows a tool 70 generally similar to tool 50, except in its anti-torque engagement means 71. This means is a splined sector wrench 72 joined to leg 52 by a hinge. It has internal splines 73, and a gap 74 which will pass the diameter of second tubing segment 75. Segment 75 has anti-torque engagement means 76 in the form of splines 77 that engage splines 73.

Figure 8:
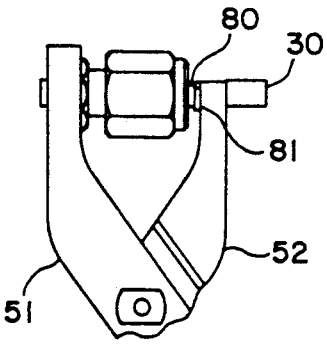
FIG. 8 is a fragmentary plan view of yet another embodiment of the invention.

FIG. 8 shows a planar face 80 on leg 52 to abut shoulder 81 on segment 30.

Figure 9:
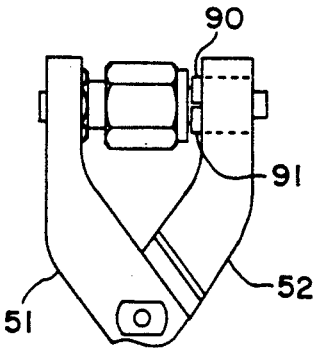
FIG. 9 is a fragmentary plan view of still another embodiment of the invention.

FIG. 9 shows a pair of collet segments 90,91 on leg 52 to bear against the grasp the second tubing segment.

Figure 10:
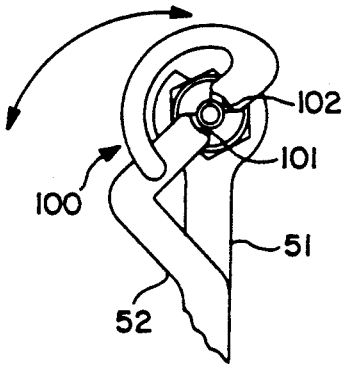
FIG. 10 is an end view, partly in schematic notation showing yet another embodiment of the invention.

FIG. 10 shows a spanner wrench 100 on arm with gripping faces 101, 102 to bear against and grasp the second tubing segment.

FIGS. 9 and 10 illustrate the face that the cylindrical part of the tubing segment can be used as the other part of a pair of anti-torque engagement means at the female nut. Generally it will be preferred to take advantage of an enlarged shoulder on the second tubing segment.

Figure 11:
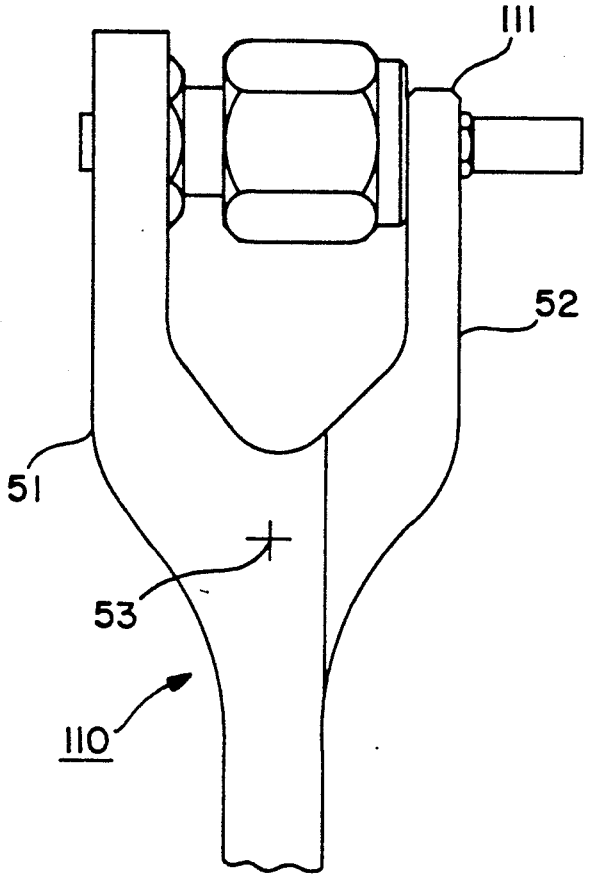
FIG. 11 is a fragmentary side view of yet another embodiment of the invention.
Figure 12:
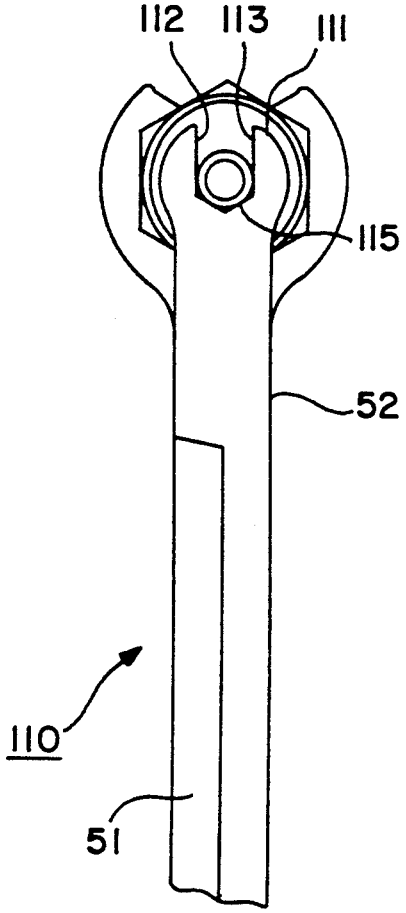
FIG. 12 is a right hand side view of FIG. 11.

FIGS. 11 and 12 show a tool 110 with an open ended wrench 111 having flats 112,113 on leg 52. Wrench 111 engages two flats of a hexagonal array 115 on the second tubing segment. The wrench and the array are anti-torque engagement means.

As in all unions, materials of construction suitable for handling the intended fluids will be used. Suitable stainless steels are most frequently used. The relative properties of the beads (or even their identity) and the washer are selected so the illustrated deformation can occur. Of course, reversal of the bead and washer surface is within the intended scope of the invention, with the washer faces contoured and the tubing faces flat, but the illustrated embodiment is preferred.

With the use of this invention, the simplest VCR can be installed to optimum specifications, with little or not twist between the tubing segments.

This invention is not to be limited by the embodiments shown in the drawings and described in the description, which are given by way of example and not of limitation, but only in accordance with the scope of the appended claims.

I claim:

1. In combination:

a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, and anti-torque engagement means; a sealing washer interposed between said first and second segments for compressive fluid sealing contact; a peripheral bead formed on each said segment or on said washer, and a mating surface on the other; and a tool for assembling said union so as to join said segments together, said tool comprising: a first leg and a second leg; pivot means joining said legs together for scissor-like movement, each leg having anti-torque engagement means, one respective to and engageable with each of said anti-torque engagement means on said first nut and on said second segment;

said anti-torque engagement means on said second segment being planar, and said anti-torque engagement means on said second leg being serrated.

2. In combination:

a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, and anti-torque engagement means; a sealing washer interposed between said first and second segments for compressive fluid sealing contact; a peripheral bead formed on each said segment or on said washer, and a mating surface on the other; and a tool for assembling said union so as to join said segments together, said tool comprising: a first leg and a second leg; pivot means joining said legs together for scissor-like movement, each leg having anti-torque engagement means, one respective to and engageable with each of said anti-torque engagement means on said first nut and on said second segment;

said anti-torque engagement means on said second segment being an array of axial splines, and said anti-torque engagement means on said second leg being an array of mating axial splines.

3. In combination:

a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, and anti-torque engagement means; a sealing washer interposed between said first and second segments for compressive fluid sealing contact; a peripheral bead formed on each said segment or on said washer, and a mating surface on the other; and a tool for assembling said union so as to join said segments together, said tool comprising: a first leg and a second leg; pivot means joining said legs together for scissor-like movement, each leg having anti-torque engagement means, one respective to and engageable with each of said anti-torque engagement means on said first nut and on said second segment;

said anti-torque engagement means on said second segment being planar, and said anti-torque engagement means on said second leg being a collet.

4. In combination:

a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, and anti-torque engagement means; a sealing washer interposed between said first and second segments for compressive fluid sealing contact; a peripheral bead formed on each said segment or on said washer, and a mating surface on the other; and a tool for assembling said union so as to join said segments together, said tool comprising: a first leg and a second leg; pivot means joining said legs together for scissor-like movement, each leg having anti-torque engagement means, one respective to and engageable with each of said anti-torque engagement means on said first nut and on said second segment;

said anti-torque engagement means on said second segment being planar, and said anti-torque engagement means on said second leg being a spanner wrench.

5. A tool for assembling a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, a anti-torque engagement means; a sealing washer interposed between said first and second segments for compressive fluid sealing contact; a peripheral bead formed on each said segment or on said washer, and a mating surface on the other;

said tool comprising: a first leg and a second leg; pivot means joining said legs together for scissor-like movement, each leg having anti-torque engagement means, one respective to each of said anti-torque engagement means on said first nut and on said second segment to hold the respective first nut and second tubing segment against relative rotation;

said anti-torque engagement means on said second segment being planar, and said anti-torque engagement means on said second leg being serrated.

6. A tool for assembling a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, a anti-torque engagement means; a sealing washer interposed between said first and second segments for compressive fluid sealing contact; a peripheral bead formed on each said segment or on said washer, and a mating surface on the other;

said tool comprising: a first leg and a second leg; pivot means joining said legs together for scissor-like movement, each leg having anti-torque engagement means, one respective to each of said anti-torque engagement means on said first nut and on said second segment to hold the respective first nut and second tubing segment against relative rotation;

said anti-torque engagement means on said second segment being an array of axial splines, and said anti-torque engagement means on said second leg being an array of mating axial splines.

7. A tool for assembling a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, a anti-torque engagement means; a sealing washer interposed between said first and second segments for compressive fluid sealing contact; a peripheral bead formed on each said segment or on said washer, and a mating surface on the other;

said tool comprising: a first leg and a second leg; pivot means joining said legs together for scissor-like movement, each leg having anti-torque engagement means, one respective to each of said anti-torque engagement means on said first nut and on said second segment to hold the respective first nut and second tubing segment against relative rotation;

said anti-torque engagement means on said second segment being planar, and said anti-torque engagement means on said second leg being a collet.

8. A tool for assembling a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, a anti-torque engagement means; a sealing washer interposed between said first and second segments for compressive fluid sealing contact; a peripheral bead formed on each said segment or on said washer, and a mating surface on the other;

said tool comprising: a first leg and a second leg; pivot means joining said legs together for scissor-like movement, each leg having anti-torque engagement means, one respective to each of said anti-torque engagement means on said first nut and on said second segment to hold the respective first nut and second tubing segment against relative rotation;

said anti-torque engagement means on said second segment being planar, and said anti-torque engagement means on said second leg being a spanner wrench.

9. A tool for assembling a union for joining two tubing segments together which union has a central axis and comprises: a first nut with an external thread, anti-torque engagement means, a central passage and a compression shoulder; a second nut with an internal thread for mating with said external thread, a compression shoulder, a central passage, and a wrench-engaging section; a first tubing segment passing through the passage in the first nut with a side clearance, a peripheral compression shoulder facing the compression shoulder on the first nut and a flow passage extending from end to end of said first segment; a second tubing segment passing through said passage in said second nut with a side clearance, a peripheral compression shoulder facing said compression shoulder on said second nut, a flow passage extending from end to end of said second segment, anti-torque engagement means; a sealing washer interposed between said first and second segments for compressive fluid sealing contact; a peripheral bead formed on each said segment or on said washer, and a mating surface on the other;

said tool comprising: a first leg and a second leg; pivot means joining said legs together for scissor-like movement, each leg having anti-torque engagement means, one respective to each of said anti-torque engagement means on said first nut and on said second segment to hold the respective first nut and second tubing segment against relative rotation;

said anti-torque engagement means on said second segment being planar, and said anti-torque engagement means on said first leg being a wrench, said wrench including a shoulder which when applied to said first nut axially bears against said first nut.

* * * * *